United States Patent [19]

Simonton et al.

[11] Patent Number: 5,074,009

[45] Date of Patent: Dec. 24, 1991

[54] DRAWER OR DOOR PULL

[75] Inventors: Ronald Simonton, Stonington; Mark G. Stasko, Woodstock Valley, both of Conn.

[73] Assignee: Herman Miller, Inc., Zeeland, Mich.

[21] Appl. No.: 461,632

[22] Filed: Jan. 8, 1990

[51] Int. Cl.[5] ..... A47B 88/00; A47B 95/00

[52] U.S. Cl. ..... 16/124; 312/320

[58] Field of Search ..... 16/124; 312/320

[56] References Cited

U.S. PATENT DOCUMENTS

D. 132,687 6/1942 Kupperman .
D. 142,942 11/1945 Borchers .
D. 148,200 12/1947 Tompkins .
D. 153,835 5/1949 Sundberg et al. .
D. 170,968 12/1953 Claus .
D. 173,195 10/1954 Duncan .
D. 192,787 5/1962 Dyer .
D. 201,430 6/1965 Stone .
D. 247,663 4/1978 Spellier .
D. 297,808 9/1988 King .
1,976,118 10/1934 Cruikshank .
2,793,386 5/1957 Muhlhauser .
3,932,010 1/1976 Kenworthy ..... 16/124
4,744,126 5/1988 Bisbing .

FOREIGN PATENT DOCUMENTS 497662 11/1953 Canada ..... 16/124

*Primary Examiner*—Robert L. Spruill
*Assistant Examiner*—Carmine Cuda
*Attorney, Agent, or Firm*—Varnum, Riddering, Schmidt & Howlett

[57] ABSTRACT

The invention relates to a system for assembling a pull adapted to be received within an opening in a furniture article. The pull comprises a back element, a frame element and a grip element. The system comprises a plurality of at least one of the elements, the elements of the plurality being interchangeable with one another. Each element of the plurality has a finish different from that of at least one other element of the plurality such that a selection of finishes for at least one element of the pull is provided.

13 Claims, 3 Drawing Sheets

DRAWER OR DOOR PULL

BACKGROUND OF THE INVENTION

1. Field of the Invention

This invention relates to a drawer or door pull and, more particularly, to a drawer or door pull comprising a plurality of components each of which can be provided with any one of a number of finishes to create variety of visual effects.

2. Description of the Related Art

The visual appearance of furniture is an important consideration for a purchaser. Appearance becomes an even more considered factor when significant monetary expenditures are made, for example, to furnish large office environments.

Oftentimes, in order to secure volume purchasing discounts, a purchasing agent or the like requests that a furniture manufacturer provide furnishings having substantially similar finishes, resulting in the outfitting of several offices in virtually identical fashion. Only on occasion will the purchasing agent be able to request that the manufacturer provide furniture having a variety of finishes, for example, a light maple veneer and a darker oak or mahogany.

However, for middle and upper echelon executives and management personnel, handsomely and distinctively appointed offices are one subtle but tangible mark of position and success within the organization. To the extent that several offices are decorated with virtually identical furnishings, an opportunity for individuality, distinction and variety is lost.

Therefore, it is an object of the invention to provide a simple, inexpensive technique for varying the visual appearance of furniture articles that are otherwise quite similar. It is also an object of this invention to vary the appearance of furniture through the use of door and drawer pulls each comprising several components. Further, each of the components can be provided with one of a variety of finishes such that the several components may be "mixed and matched" to create a myriad of alternative and aesthetically pleasing combinations.

SUMMARY OF THE INVENTION

According to the present invention, a system for assembling at least one pull for furniture, the pull comprising a back element, a frame element and a grip element. The pull is adapted to be received in a complementary opening in an article of furniture, with the back element being disposed at the rear of the opening. The frame element and the grip element are adapted to form a lining for at least a portion of the opening outwardly of the back element.

The system comprises a plurality of at least one of the element. The elements of the plurality being interchangeable with one another. Each element of the plurality has a finish different from that of at least one other element of the plurality. In this manner, a selection of finishes for at least one element of the pull in the assembly thereof is provided.

BRIEF DESCRIPTION OF THE DRAWINGS

The invention will now be described with reference to the drawings in which.

DETAILED DESCRIPTION OF THE PREFERRED EMBODIMENTS

Figure 1:
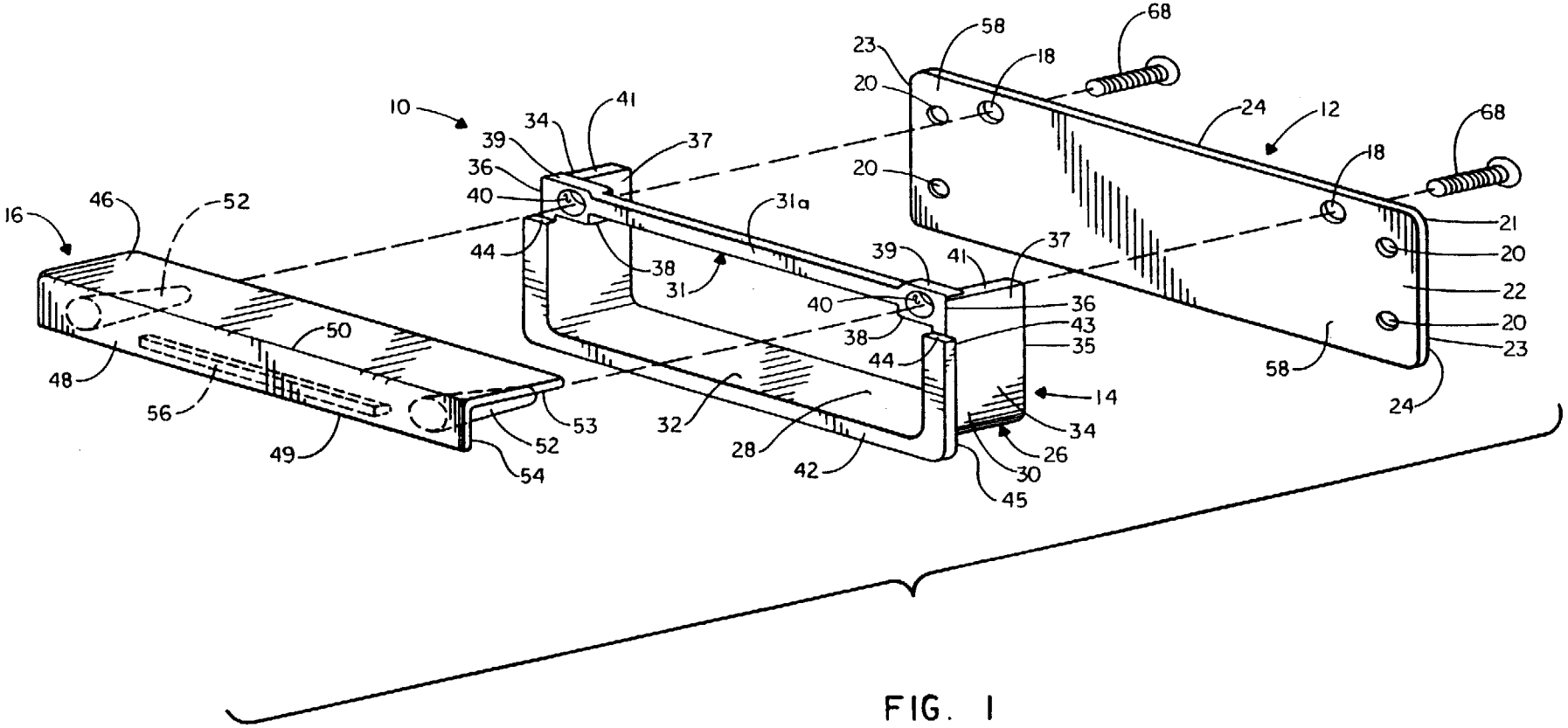
FIG. 1 is an exploded perspective view of a drawer or door pull according to the invention.

Turning now to the drawings in detail, a drawer or door pull is identified generally by the reference numeral 10. Although the term drawer pull is referred to hereinbelow, it will be understood that the pull may be used in association with either a drawer, a door or other furniture component. The drawer or door pull 10 comprises three principal elements, a base or back plate 12 (also referred to as the "back element"), a liner or insert 14 (also referred to as the "frame element"), and a pull grip 16 (also referred to as the "grip element").

The back plate 12 is a generally rectangular member having a pair of plate mounting apertures 18 and a plurality of pull mounting apertures 20 therethrough. The back plate 12 has a front face 22 and a rear face 24 opposite the front face. The plate mounting apertures 18 are positioned adjacent to an upper edge 21 of the plate 12. A pair of pull mounting apertures 20 is placed adjacent to each side edge 23 of the plate 12.

The insert 14 comprises a substantially U-shaped body portion 26 having an interior surface 28 and an exterior surface 30, a web 32 intermediate a pair of parallel legs 34, 34, and a rear edge 35. A front, upper corner 36 at a distal end 37 of each leg 34 is provided with an inwardly directed mounting ear 38, each ear having an upper edge 39 and a centrally located through bore 40. A support brace 31 having a front face **31*a* spans between and is integral with the mounting ears 38. Each leg 34 terminates in an upper edge 41. The insert 14 further includes an outwardly extending marginal flange 42 along a front edge 43 of the U-shaped body 26. The flange 42 extends along the front edge of the web 32, upwardly along each leg 34, and terminates in a flat, upper surface 44 adjacent to and below each inwardly directed mounting ear 38. The flange 42 also includes a rear surface 45**.

The pull grip 16 is a substantially L-shaped member comprising a top wall 46 and a front wall 48 depending in a substantially normal direction from a front edge 50 of the top wall. The front wall 48 has a lower edge 49; the top wall 46 has an underside 53. A pair of barrels or bosses 52 are mounted, for example, by welding or brazing, to an inside surface 54 of the front wall 48, the barrels extending substantially parallel to each other in a direction transverse to the longitudinal axis of the top wall. Each barrel is provided with a threaded bore (not shown) extending inwardly from a rear surface of the barrel. The barrels 52 are spaced below the top wall 46, the significance of which is explained below. A rib 56 extends normally and rearwardly from the inside surface 54 of the front wall 48 adjacent to the front wall lower edge 49. The rib 56 is formed intermediate the barrels 52.

Figure 2:
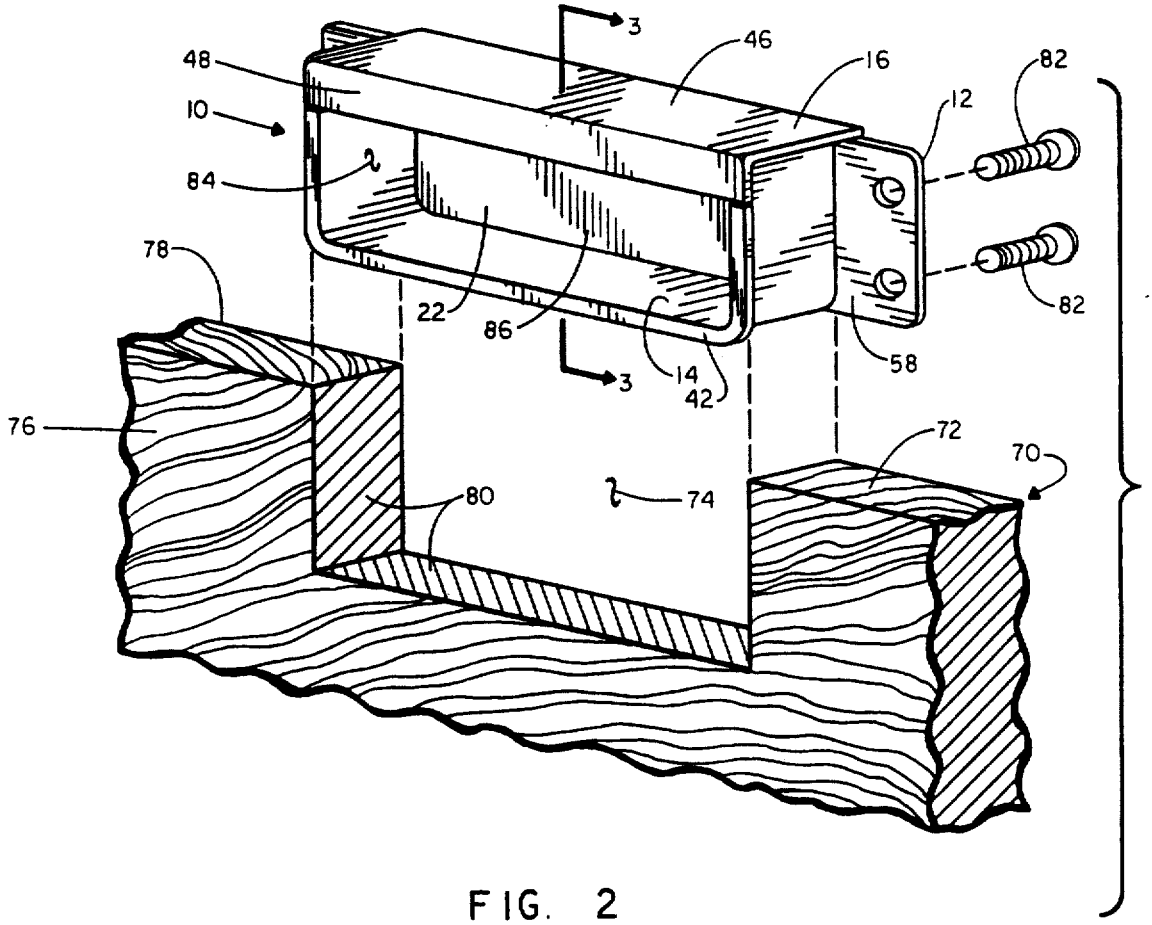
FIG. 2 is an exploded perspective view of a fully assembled drawer or door pull and an edge portion of a drawer or door.
Figure 3:
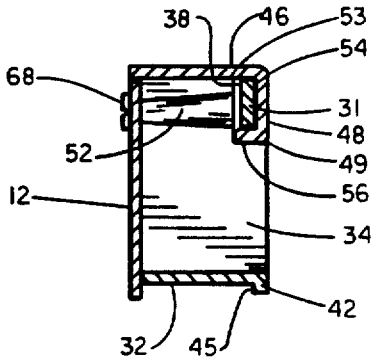
FIG. 3 is a sectional view taken along lines 3—3 of FIG. 2.

FIG. 1 shows the assembly of the base 12, the liner 14 and the pull grip 16 to yield the drawer or door pull 10 as shown in FIG. 2. In assembly, the rear edge 35 of the U-shaped body 26 is engaged with the front face 22 of the base 12, the pair of plate mounting apertures 18 being aligned with the bores 40 in the inwardly directed mounting ears 38. The pull grip 16 is positioned such that the threaded barrels 52 are received within the bores 40 in the mounting ears 48 and are aligned with the apertures 18. The upper edges 41 of the legs 34 and the upper edges 39 of the mounting ears 38 engage or are closely adjacent to the underside 53 of the top wall 46. The lower edge 49 of the front wall 47 engages or is closely adjacent to the flat upper surface 44 of the marginal flange 42. The support brace 31 bears against the inside surface 53 of the front wall 48 between the top wall 46 and the rib 56. The base 12, the liner 14 and the pull grip 16 are secured to each other by way of screws 68 or other mechanical fasteners that register with the plate mounting apertures 18, the bores 40, and the threaded barrels 52. When the U-shaped body 26 is secured to the base 12, side portions 58 extend laterally relative to the liner 14 and the pull grip 16, the significance of which is explained hereinbelow.

Figure 4:
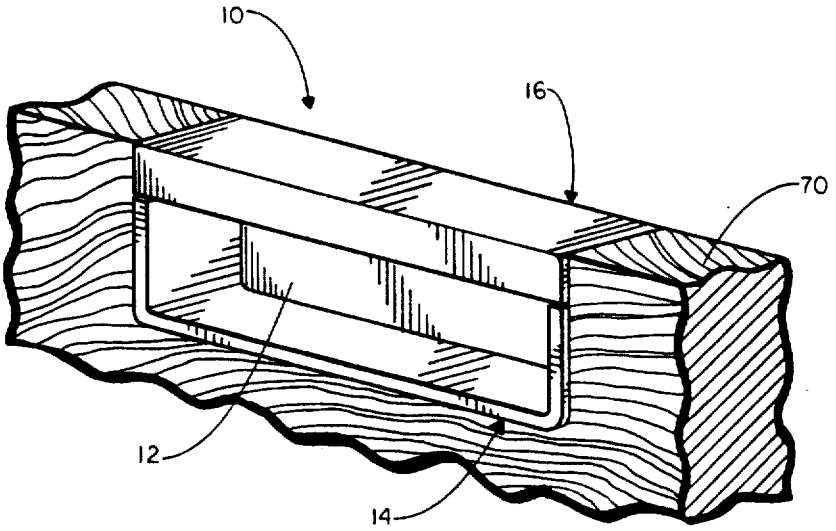
FIG. 4 is a perspective view of the pull of FIGS. 1, 2 and 3 mounted on the drawer or door.

The mounting of the fully assembled drawer or door pull 10 to a drawer or door 70 is best shown in FIG. 2. It will be understood that the reference numeral 70 identifies a portion of a drawer or door without being limited to one or the other. The drawer or door 70 includes an edge portion 72 having a notch, opening or cutout 74 therein, an outer face 76, an inner face 78, and notch walls 80. The drawer or door pull 10 is mounted to the drawer or door 70 by the registration of the pull with the notch or cutout 74. The exterior surface 30 of the U-shaped body portion 26 engages the notch walls 80, the side portions 58 engage the inner face 78 of the drawer or door 70 and the rear surface 45 of the marginal flange 42 engages the outer face 76 of the drawer or door. Screws or other mechanical fasteners 82 register with the pull mounting apertures 20 and are received by the drawer or door 70 to securely fasten the pull 10 to the same. FIG. 4 illustrates the pull 10 after it has been mounted to the drawer or door 70.

The fully assembled drawer or door pull 10 provides a hand engageable recess 84 defined by the front face 22 of the base 12, the interior surface 28 of the U-shaped body 26, and the top and front walls, respectively, 46 and 48, of the pull grip 16. In operation, a hand of a user (not shown separately in the drawings) is positioned within the hand engageable recess 84, the fingers of the user grasping the front wall 48 and applying an outwardly directed motion to open the drawer or door 70.

Figure 5:
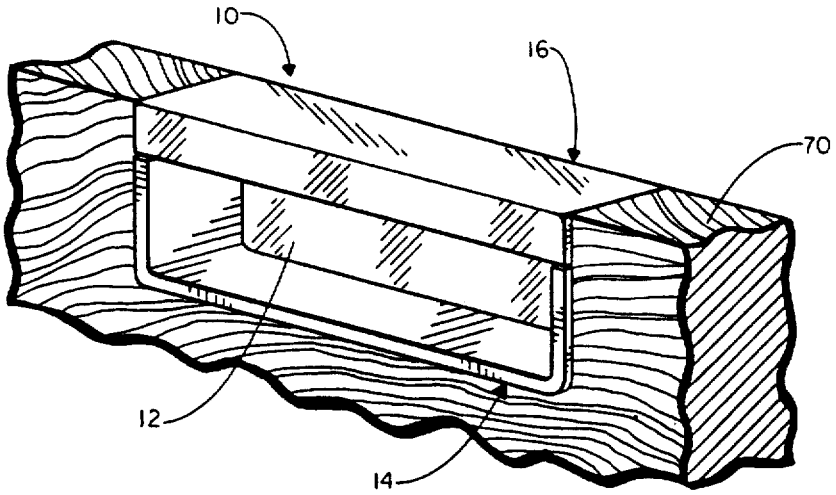
FIG. 5 is a perspective view similar to FIG. 4, showing a pull in which only two of the components thereof have been provided with a similar finish.
Figure 6:
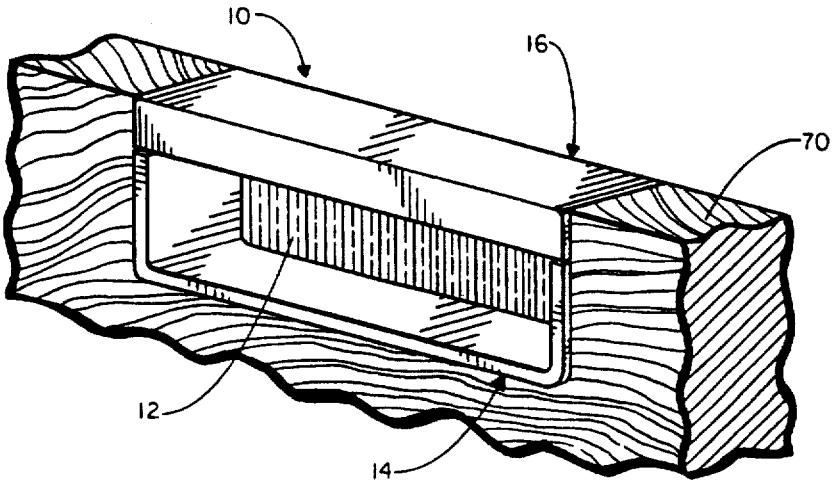
FIG. 6 is a perspective view similar to FIGS. 4 and 5, showing a pull in which each of the components thereof has been provided with a different finish.

From the drawings, it can be seen that when the pull 10 is secured to a drawer or door 70, a portion 86 of the front face 22 of the base 12, the interior surface 28 and the marginal flange 42 of the U-shaped body 26, and the top and front walls 46, 48 of the pull grip 16 present surfaces that are visible to a user. Because the base 12, the liner 14 and the pull grip 16 are individual components each possessing at least one of the surfaces visible to a user, it is possible to manufacture each component with a different surface finish such as polished brass, antique bronze, polished chrome, or flat black. As shown in FIGS. 4 to 6, a pull 10 in which the base 12, the liner 14 and the pull grip 16 have the same or different finishes may be provided to create a variety of visual effects. For example, each of the three components may have the same finish (FIG. 4), each may have a different finish (FIG. 6), or two of the components (the base 12 and the pull grip 16) may have a finish that is the same but different from the finish of the third component (the liner 14) (FIG. 5).

Similarly, because the drawer or door pull 10 is easily mounted to a drawer or door 70, it is possible to specify to a manufacturer of the furniture, that substantially identical articles of furniture be provided but which differ in the style and finish of the pulls. Thus, a purchasing agent can receive volume purchasing discounts by ordering basic furniture articles that are identical yet still furnish offices with distinct and individual articles of furniture. As well, as tastes change with time or as new individuals make use of existing furniture, the pulls 10 may be readily replaced with pulls having different combinations of the available finishes to satisfy changing desires or to individualize existing furniture to suit the personal preferences of the user.

Reasonable variations or modifications are possible within the spirit of the foregoing specification and drawings without departing from the scope of the invention which is defined in the accompanying claims.

The embodiments of the invention in which an exclusive property or privilege is claimed are defined as follows:

1. A system for assembling at least one pull for furniture, said pull comprising a back element, a frame element and a grip element and being adapted to be received in a complementary opening in an article of furniture with said back element disposed at a rear of the opening, said frame element and said grip element being adapted to form a lining for at least a portion of said opening outwardly of said back element, each of said back element, said frame element, and said grip element having a surface which is adapted to be visible from a front of said article, said visible surface of said back element being visible through the opening when the pull is assembled, said system comprising a plurality of at least one of said elements, the elements of said plurality being interchangeable with one another, each element of said plurality having a finish on its respective visible surface different from that of at least one other element of said plurality, whereby to provide a selection of visible finishes for said at least one element of said pull in the assembly thereof.

2. A system according to claim 1, wherein said pull further comprises means for mounting said grip element on said frame element.

3. A system according to claim 2, wherein said mounting means is further adapted to secure said grip element and said frame element to said back element.

4. A system according to claim 3, wherein said mounting means comprises at least one first member on and extending inwardly from said grip element, and at least one second member on said frame element, said first and second members being adapted to cooperate to mount said grip element on said frame element.

5. A system according to claim 4, wherein said first member comprises an inwardly extending barrel and said second member comprises a flange having a hole therethrough adapted to receive said barrel to mount said grip element on said frame element.

6. A system according to claim 5, wherein said mounting means further comprises a threaded bore within said barrel and adapted to be aligned with said hole when said grip element is mounted on said frame element, said mounting means also comprising an orifice extending through said back element and adapted to be aligned with said aligned bore and hole, said mounting means further comprising a threaded shaft adapted to be received within said aligned bore, hole and orifice and engage said barrel to mount said grip element and said frame element on said back element.

7. A system according to claim 6, wherein said pull further comprises means for fastening said back element to an article of furniture.

8. A system according to claim 7, wherein said fastening means comprises at least one aperture extending through said back element and a shaft adapted to be received within said aperture and engage the article of furniture to fasten the back element to the article of furniture.

9. A system according to claim 1, wherein said grip element comprises a grip portion adapted to be disposed outwardly from said back element when said pull is assembled to provide a space behind said grip portion.

10. A system according to claim 1, wherein the frame element and the grip element are adapted to define a frame surrounding said opening through the article of furniture.

11. A system according to claim 1, wherein said frame element is adapted to line a complementary portion of the perimeter of said opening through the article of furniture.

12. A system according to claim 11, wherein said grip element includes a frame portion adapted to cooperate with said frame element to surround said opening through the article of furniture.

13. A system for assembling a plurality of pulls for furniture, each of said pulls comprising a back element, a frame element and a grip element and being adapted to be received in a complementary opening in an article of furniture with said back element disposes at a rear of the opening, said frame element and said grip element being adapted to form a lining for at least a portion of said opening outwardly of said back element, each of said back element, said frame element, and from a front of said article, said visible surface of said back element being visible through the opening when the pull is assembled, said system comprising a plurality being interchangeable with one another and having finishes on their respective visible surfaces different from the finishes on the visible surfaces of other elements of that plurality, whereby to provide a selection of visible finishes for each of the pulls to be assembled.

* * * * *

UNITED STATES PATENT AND TRADEMARK OFFICE

CERTIFICATE OF CORRECTION

PATENT NO. : 5,074,009

DATED : December 24, 1991

INVENTOR(S) : RONALD SIMONTON and MARK G. STASKO

It is certified that error appears in the above-identified patent and that said Letters Patent is hereby corrected as shown below:

Col. 6, claim 13, line 11:
"disposes" should be --disposed--.

Col. 6, claim 13, line 15:
after "and" insert --said grip element having a surface which is adapted to be visible--.

Col. 6, claim 13, line 18:
after "plurality" insert --of each of said elements, the elements of each plurality--.

Signed and Sealed this

Thirteenth Day of April, 1993

*Attest:*

STEPHEN G. KUNIN

*Attesting Officer*

*Acting Commissioner of Patents and Trademarks*